United States Patent [19]

Baer et al.

[11] 4,039,267

[45] Aug. 2, 1977

[54] METHOD AND APPARATUS FOR STARTING A BLOWER

[75] Inventors: Jurgen Baer, Magenwil; Hans-Dieter Sommer, Oberrohrdorf; Ernst Toplak, Windisch, all of Switzerland

[73] Assignee: BBC Brown Boveri & Company Limited, Baden, Switzerland

[21] Appl. No.: 635,349

[22] Filed: Nov. 26, 1975

[30] Foreign Application Priority Data

Dec. 18, 1974 Switzerland ..... 16880/74

[51] Int. Cl.[2] ..... F01D 19/00

[52] U.S. Cl. ..... 415/1; 415/11; 415/22; 415/52

[58] Field of Search ..... 415/1, 11, 22, 52

[56] References Cited

U.S. PATENT DOCUMENTS

| | | | |
|---|---|---|---|
| 2,470,565 | 5/1949 | Loss | 415/11 |
| 2,986,327 | 5/1961 | Hunter | 415/11 |
| 3,240,422 | 3/1966 | Pettersen et al. | 415/1 |
| 3,362,626 | 1/1968 | Schlirf | 415/1 |
| 3,737,246 | 6/1973 | Shirato | 415/1 |

*Primary Examiner*—Henry F. Raduazo

*Attorney, Agent, or Firm*—Pierce, Scheffler & Parker

[57] ABSTRACT

A method for starting a blower in the form of a single-stage radial fan installed in a pressure system such as the circulating cooling system of a turbogenerator in which the resistance of the pressure system is varying during the starting operation by means of a starting duct provided with a throttling element. The throttling element is closed at any desired blower speed ranging from 10 to 100% of its rated speed when the point of intersection between the pressure system characteristic, modified on the basis of the open throttling element, and the blower characteristic has been reached whereupon the desired point of operation conforming to the blower characteristic and the system characteristic will regulate itself automatically.

5 Claims, 6 Drawing Figures

METHOD AND APPARATUS FOR STARTING A BLOWER

Figure 1:
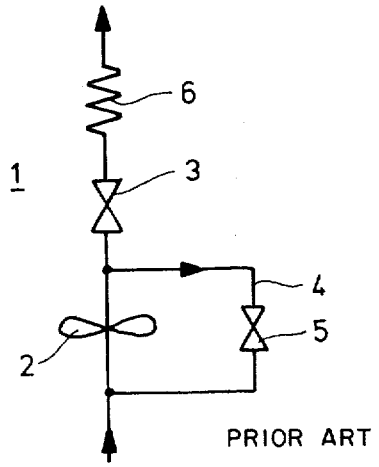
Fig. 1 PRIOR ART

This invention relates to an improved method for starting a blower, especially a single-stage radial flow fan with a pressure coefficient greater than 1 and with a defined region of flow disruption along the characteristic curve of the blower, within a pressure system, for example the circulating cooling system of a turbogenerator, where the resistance of the system can be varied during the starting operation by means of a starting duct which is provided with a throttling element. An apparatus for the practical application of this method is also an object of the invention.

It is known that the characteristic curves of blowers show regions of instability, especially in the case of axial flow compressors, as well as more or less defined regions of flow disruption, especially in the case of radial flow fans. Experts in this technological field have considered these regions of instability and flow disruption to be unusable for starting purposes, at least in part. J. H. Horlock discusses on page 175 of his book "Axialkompressoren", published 1958 by G. Braun, Karlsruhe, the problem arising in a pressure system, containing a throttling element. His analysis is based on a uniform blower speed, and there are shown the blower characteristic with a positive and a negative branch and the variable resistance curve of the pressure system. It was found that the characteristic of a blower becomes unstable at a sufficiently sharp throttling of the flow volume. Such sharp throttling with occur regularly in the case of a steep resistance curve. As a result of an analysis of the positive, rising branch of the blower characteristic it was found that a stable operation will be possible only, if the slope of the resistance curve is greater than the slope of the blower characteristic. From this teaching it can be concluded that it will not be possible to design a blower for a specific pressure system in such manner that system characteristic and blower characteristic will intersect at the peak of the latter, i.e. the point representing the highest possible pressure coefficient which can be attained.

The same conclusion is reached by B. Eck on page 397 of his book "Ventilatoren", 5th edition, 1972, Springer-Verlag Berlin/Heidelberg/New York, but he does overcome this problem at least partially by use of a by-pass pipe. He demonstrates a method for the starting of blowers in pressure systems on the basis of a pressure-volume diagram and a circuit chart which will be described below. A by-pass pipe, surrounding the blower and containing an adjustable throttle of variable resistance, serves to return the flow to the suction intake of the blower from the time of start until the machine reaches the designed speed. Therefore, there is no delivery into the pressure system taking place, and a slide valve, cutting off the pressure system, is required. The unusable unstable region of the blower characteristic is avoided by detour, and at the designed speed the blower operates at a reference point of low pressure and high flow mass. In accordance with this method, the slide valve, leading to the pressure system, is opened gradually until it is open completely, thus increasing the flow volume, with the pressure dropping still further. A small quantity will enter the pressure system now for the first time while the greater part of the flow volume will continue to flow through the by-pass pipe until the throttle, located within the pipe, closes completely.

Only at this time will the temporary operational reference point of the characteristic move up to the proper point of operations.

The disadvantages of this starting method are obvious from the description given above. First, there is needed a slide valve with a variable resistance to close off the pressure system. Secondly, full feed pressure will come into being only after the designed speed has been reached and after consecutive manipulations of two throttling elements.

These disadvantages definitely preclude the use of the above described starting method for cooling blowers of turbogenerators. In order to hold down the axial length of the turbogenerator, it is necessary to utilize single-stage blowers, and the maximum diameter of such blowers is limited for reasons of engineering (retraction of the rotor into the stator). In order to attain the required pressure ratio, the blower must have a high pressure coefficient, a design which by necessity will result in correspondingly extensive regions of flow disruption along the characteristic curve if radial blowers are involved. The region of flow disruption divides the curve into an upper and lower branch, with the point of operations being located at the latter if the resistance curve of the cooling system runs through this region. Such point of operations is characterized by a low pressure coefficient, a low degree of efficiency and a strong fan noise. For these reasons it has been necessary to design the fan in such manner that the given resistance curve will run at a safe distance from the region of flow disruption. However, even though the point of operations will then appear at the upper branch of the characteristic curve, such arrangement will result in an attainable pressure coefficient lower than would be possible in view of the values of the fan characteristic, and the blower will further operate at a relatively low degree of efficiency, in other words with a correspondingly greater power adsorption.

It is the primary object of the invention to avoid the above discussed disadvantages, and further to establish an improved method, as well as a novel apparatus for its practical application, which will make it possible to utilize, during the start of the blower, the branch above the region of flow disruption of the blower characteristic, a region of the branch which heretofore has been considered unattainable and unuseable.

The invention solves the problem in this manner that the throttling element will be closed when the point of intersection between the system characteristic curve, modified on the basis of the open throttling element, with the blower curve has been reached, at a blower speed, adjustable as desired, between 10 and 100% of its rated speed, whereupon the desired point of operations — in conformity with the blower characteristic and the system characteristic — will align automatically.

The invention offers the advantage that it will now become possible to utilize a blower fan wheel with a very high pressure coefficient which is reliable in operation.

It will be expedient if the aperture ratio of the throttling element is adjusted constantly at increasing blower speed gradually and in a manner inversely proportional to the prevailing pressure coefficient. It becomes thus possible even at the time of starting the machine to increase the pressure coefficient constantly and smoothly up to its highest attainable value.

A further object of the invention is to provide a novel apparatus, characterized by a starting duct which is made a part of the blower system and which is provided with a throttling element. This very simple device can be used not only for newly designed machines but can also be installed readily in pressure systems which are already operational. It will be advantageous if such a starting duct is designed in the form of a by-pass pipe detouring the blower.

If the throttling element is provided with a spring-loaded closure member and if the spring means are designed in such manner that the spring travel is proportional to the pressure exerted upon the closure member, such arrangement will result in, and offer all the advantages of an entirely mechanically and automatically operating device, requiring hardly any servicing.

Figure 2:
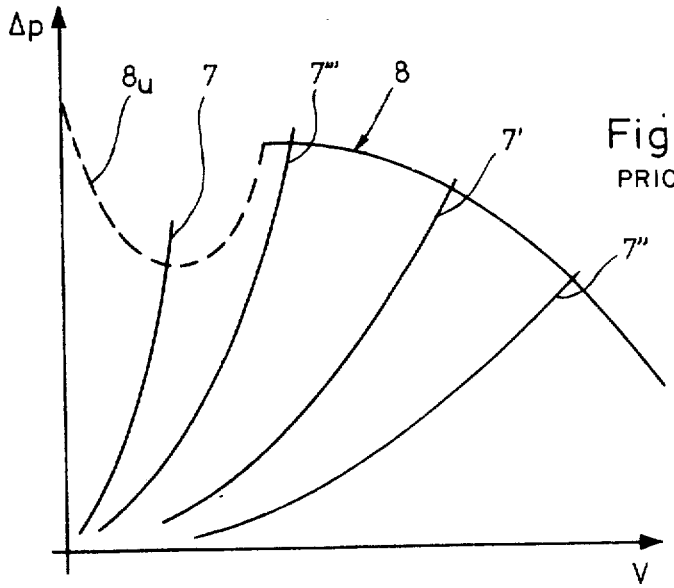
Fig. 2 PRIOR ART
Figure 3:
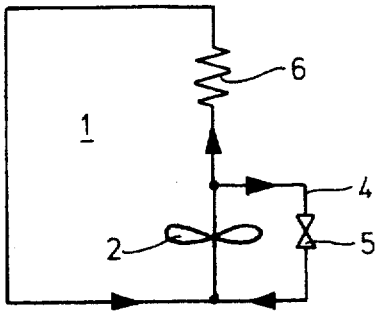
Figure 4:
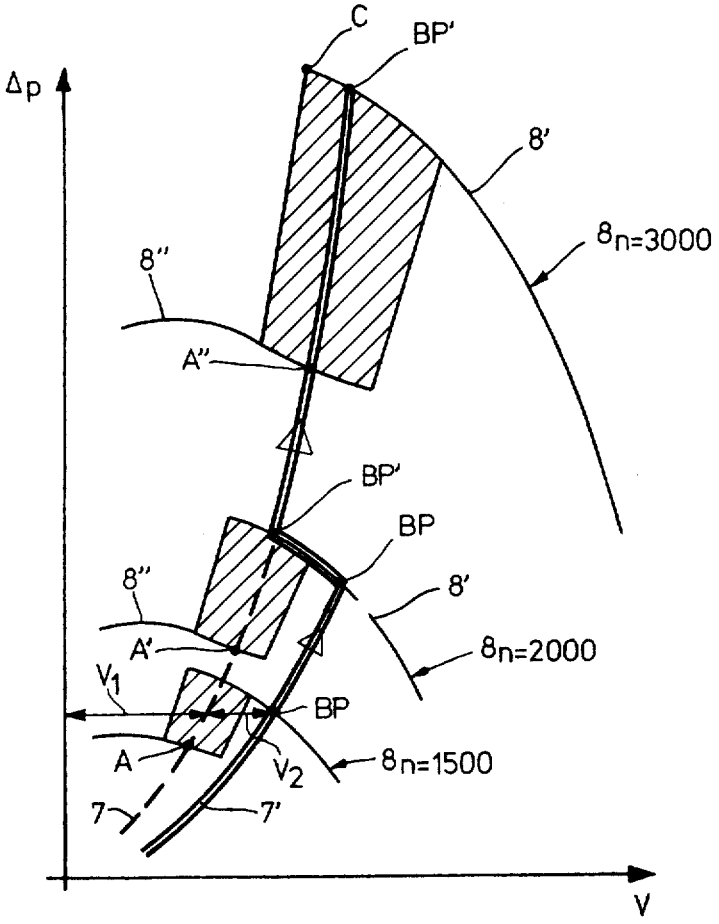
Figure 5:
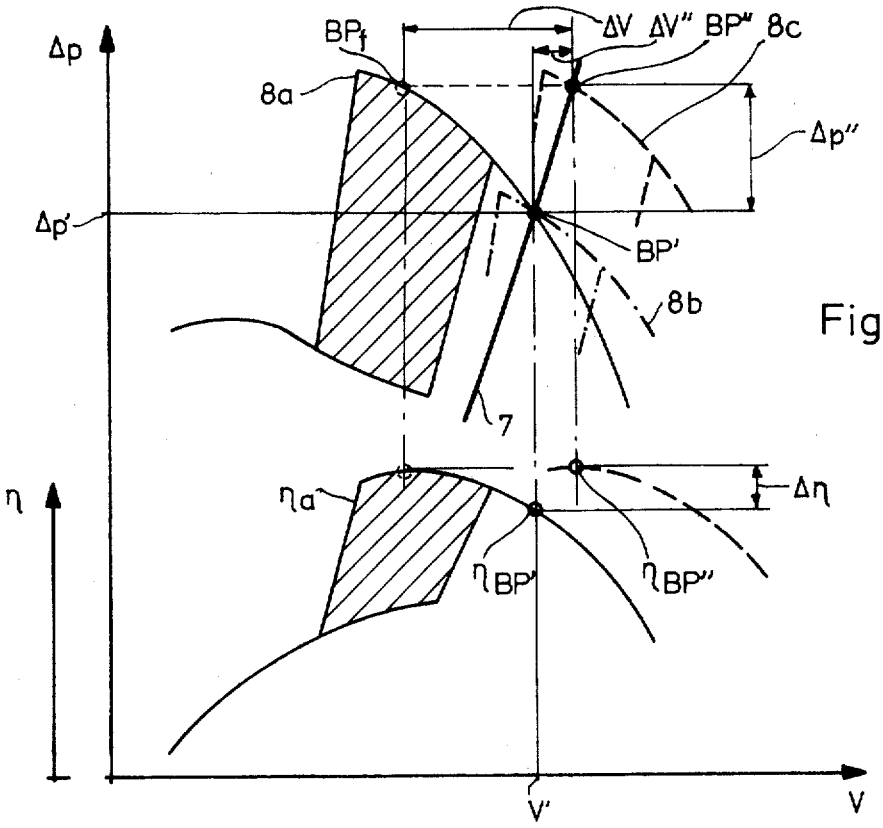
Figure 6:
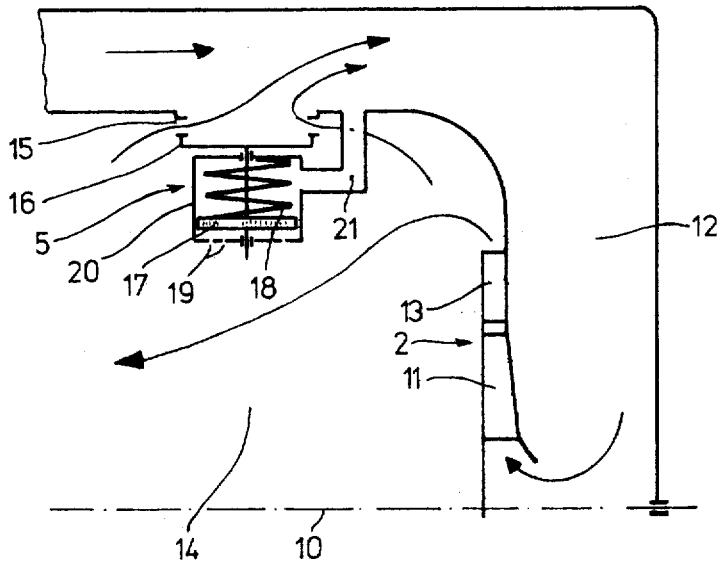

The invention will be explained below by means of practical examples illustrated in the accompanying drawings wherein:

FIG. 1 shows a pressure system with a starting aid, representing the present state of the art, in diagrammatic form, FIG. 2 depicts characteristic curves of the arrangement shown in FIG. 1 in the form of a pressure-volume graph, FIG. 3 shows a pressure system according to the invention in diagrammatic form, FIG. 4 depicts a pressure-volume graph in accordance with the invention, the arrangement shown by FIG. 3, FIG. 5 depicts characteristics of the efficiency of radial fans in pressure system, and FIG. 6 shows in diagrammatic form an axial partial section of the apparatus proposed by the invention, used in connection with an electric machine.

In the various figures identical components are identified by identical reference numerals. In the diagrams of FIGS. 1, 3 and 6 the direction of flow is indicated by the direction of the arrows. In the graphs of FIGS. 2, 4, and 5 there are plotted on the axis of abscissa the delivered volume V, and on the axis of ordinates the pressure differences $\Delta p$, to be overcome by the concerned blower.

The arrangement of a pressure system, shown in diagrammatic form by FIG. 1, and the graph in FIG. 2 are representative of the above-described known method used for the starting of blowers. Downstream of the blower 2 of a pressure system 1 there is arranged a slide valve 3 with variable resistance, with the valve in close position during the starting operation. The system resistance 6 is formed by a resistance which responds substantially to the square law. When the blower 2 is brought up to its rated speed, and the slide valve is opened slowly, the system resistance 6 and the resistance created by the slide valve 3 will be added, resulting in a resistance characteristic curve 7, appearing in the pressure-volume graph and intersecting the blower characteristic curve 8 at its unusable branch $8_u$ region, denoted by broken lines. Therefore, this starting method is not feasible. If a starting pipe, for example a by-pass duct 4, is provided around the blower 2, with a throttling element 5 possessing a variable resistance arranged within the duct and opened fully during the starting operation, the new resistance curve 7′ will intersect, at rated speed and with the slide valve 3 in closed position, the blower characteristic curve 8 at the useable branch section, but with the pressure at a low value. 7″ is a resistance curve when the slide valve 3 and the throttling element 5 are open. 7‴ represents a resistance curve with the slide valve 3 in opened, and the throttling element 5 in the closed position, its intersection with curve 8 being the desired point of operations.

FIG. 3 shows in diagrammatic form the cooling system of a turbogenerator which in the case of the invention represents the pressure system 1 and which is provided with a resistance 6, this resistance being governed substantially by a square law. Blower 2 is a single-stage radial fan with forward-bent blades, designed for the very high pressure coefficient $\psi = 1.4$. In front and in back of the radial fan there branches off a by-pass duct 4, in which there is installed an adjustable throttling element 5. There is no need for a slide valve 3, in contrast to the above described known arrangement.

The method proposed by the invention operates as follows (see FIG. 4): In this Figure there is plotted the blower characteristic curve 8 for three speeds: 1,500, 2,000 and 3,000 revolutions per minute. The region of flow disruption for all three speeds between the upper branch 8′ and the lower branch 8″ is clearly shown. It is thus obvious that the resistance curve 7 of the system will interest (A, A′, A″) the lower branch 8″ of the blower characteristic if the throttling element 5 is closed not only during the (not plotted) starting operation but also at the three speeds illustrated.

To clarify matters, there will now be described a starting process when the throttling element 5 is in its open position from the beginning of the operation. The resistance of the system, which is to be overcome and which is represented by the curve 7′, is now lower due to the parallel action of the resistances — which correspond to the element 6 and 5 —, resulting in a greater delivered volume, with the magnitude of the pressure remaining unchanged. At the speed of 1,500 rpm, $V_1$ denotes the quantity flowing through the main system, and $V_2$ the quantity flowing through the by-pass duct 4. The region of flow disruption is by-passed, and the operating point BP appears at the upper branch 8′ of the characteristic 8. At 2,000 rpm the throttling element 5 closes all at once, the original system resistance, represented by the curve 7, will now control again the operating point and which will rise, according to expectations, along the characteristic 8 from point BP, until it intersects with curve 7 at point BP′. The speed of the blower can then be raised without difficulties to 3,000 rpm, i.e. the rated speed, with the point of operations remaining steadily at the upper branch 8′ of the characteristic.

Thus, there is now a means available to design the blower in such manner that the point of operations can be placed for all practical purposes at the point of highest attainable pressure, represented by point C.

The above-described starting method by using a throttling element 5 which is open initially and which is subsequently closed all at once, can also be carried out in a modified — not illustrated — manner. It is possible to close the initially open throttling element 5 gradually during the speeding-up period of the blower 2 until the rated speed (3,000 rpm) has been reached, for example by varying the aperture ratio of the throttling element 5 inversely proportional to the prevailing pressure coefficient $\psi$. This modification will result in a particularly soft, vibrationless starting operation.

A third starting mode — not illustrated — is feasible by starting the blower 2 with the throttling element 5 in its closed position, thus placing the temporary point of operation at the lower branch 8″ of the characteristic (A, A′, A″). A brief opening of the throttling element 5 at any speed, for example the rated speed (3,000 rpm), will suffice due to the increase in the amount of flow for the shifting of the point of operation to the upper branch 8', and this point will rise at the subsequent closing of the throttling element to the desired point BP'.

Normally, this opening and closing operation will extend over a few seconds only, a process which obviously can be carried out automatically.

The last-mentioned method can be particularly important in the case of breakdowns of short duration where the quantity of flow V is reduced suddenly, causing the point of operation at C to the lower branch 8''. Since under these conditions neither pressure nor quantity of flow will satisfy the values required, it would become necessary to stop and then restart the blower. However, the method proposed by the invention does make it possible to restore the original state (point of operation BP') by a brief actuation of the throttling element.

FIG. 5 demonstrates how a suitable blower can be selected for a specific, associated resistance curve 7. For reasons of clarification the blowers, although not illustrated, are discussed by use of reference numerals. The point of operation BP', to be used, is predetermined by the required volume V' and the pressure difference $\Delta p'$ which must be overcome. Heretofore it had been necessary to select, for example, a blower 2*a* with the characteristic 8*a*, its feature a very steep run and a pronounced region of flow disruption, whereby the latter must run at a specific and safe distance from the resistance curve 7. In the graph there is plotted as a function of volume V the efficiency characteristic $\eta_a$, its run being similar to the run of the blower characteristic 8*a*. The efficiency value $\eta_{BP'}$ which matches the point of operations BP', is substantially lower than the maximum value of this characteristic curve.

The method proposed by the invention allows readily the utilization of the branch region above the region of flow disruption at the characteristic 8*a*, as indicated by the fictitious point of operation $BP_f$. It is therefore possible to design, on the basis of the specifically established values, a blower 2*b* with a characteristic 8*b* which offers the advantage of a significantly lower power consumption.

The graph demonstrates on the basis of the characteristic 8*c* how it will be possible to attain a substantial increase in pressure while using an approximately similar blower. This blower 2*c* is designed for the same pressure as the blower designed on the basis of characteristic 8*a*, but for a volume that is greater by $\Delta V$. This can be accomplished by an axial widening of the blower 2*c* to conform with the additional volume, with all other dimensions remaining unchanged. Naturally, such measure will require a greater power consumption by the blower 2*c* if the computation is based on the degrees of efficiency otherwise attainable. Obviously, the shift of the blower characteristic 8*c* by $\Delta$ V relative to 8*a* will result in a similar shift in the efficiency curve, and the new point of operation BP'' will now be usable with the degree of efficiency $\eta_{BP''}$. The efficiency improvement $\Delta\eta$ was found to be substantial, with a corresponding effect on the power consumption, with the result that the two blowers 8*a* and 8*c*, being compared, will require substantially identical motive powers. The graph demonstrates that the gains which are attainable by the method proposed by the invention are first the volume increase $\Delta V''$, and secondly the increase in pressure difference by $\Delta p''$.

FIG. 6 shows an apparatus for the practical application of the method, depicting in diagrammatic form a partial section of the coil head chamber of a turbogenerator. Components which have no bearing on the invention, such as rotor, stator, coil head and structural supports were omitted. The impeller 11 of the blower 2, driven by the — not fully illustrated — generator shaft 10, draws the cooling medium from the return duct 12, and delivers it by way of the guide system 13 to the coil head chamber 14 and to the open throttling element 5 which is located in the latter. The cross-sectional area 15 of the throttling element 5, which controls the flow resistance, is dimensionsed in such manner that during the start of the blower 2 the total resistance of the cooling system is reduced sufficiently to insure a definite by-passing of the region of flow disruption at the characteristic curve (FIG. 4). The throttling element 5 is provided with a valve disk 16 which is held in open position if the pressures in the coil head chamber 14 and in the return duct 12 are equal. This is accomplished by a coil spring 18 acting upon a piston 17, the piston being rigidly connected with the valve disk 16. The bilaterally loaded piston 17 is in communication with the coil head chamber 14 by way of apertures 19 in the valve casing 20, and with the return duct 12 by way of a pipe 21. The arrangement described and shown can be regulated in a most simple manner by a proper design of the spring, for example thusly that during the speeding up of the blower the valve disk 16 will close all at once if a specific difference in pressure occurs between the coil head chamber 14 and the return duct 12. Obviously, this closing can be accomplished also manually, or automatically, by means of any known control device, and this step can be taken at any speed desired, ranging from about 10 to 100% of the rated speed. Also, the throttling element 5 need not be closed suddenly, but the closing can be performed gradually and continuously.

Obviously, the invention is not limited to the species shown by the drawing. Instead of a closed circulation pressure system (FIG. 3) it is also possible to operate an open system, for example a mine ventilating system, on the basis of the above described method. Also, the starting duct need not run parallel to the blower but can branch off downstream from the blower, then run parallel to the system resistance and return to the system, or lead to the free atmosphere.

We claim:

1. In the method for starting a blower installed within a pressure system such as the circulating cooling system of a turbogenerator, said blower being constituted by a single-stage radial fan having a pressure coefficient greater than 1 and which includes a defined region of flow interruption along its pressure-volume characteristic curve, and wherein the resistance of the pressure system is varied during the starting operation by means of a starting duct provided with a throttling element, the improvement which resides in the step of closing said throttling element at any desired blower speed ranging from 10 to 100% of its rated speed when the point of intersection between the pressure system characteristic, modified on the basis of the open throttling element, and the blower characteristic has been reached whereupon the desired point of operation conforming to the blower characteristic and the system characteristic will regulate itself automatically.

2. The method as defined in claim 1 for starting a blower where, as the blower speed increases, the aperture ratio of the throttling element is self-regulated in a continuous manner and inversely proportional to the prevailing pressure coefficient.

3. Apparatus for starting a blower installed within a pressure system such as the circulating cooling system of a turbogenerator and wherein said blower is constituted by a single-stage radial fan having a pressure coefficient greater than 1 and which includes a defined region of flow interruption along its pressure-volume characteristic curve, which comprises a starting duct constituted by a by-pass returning the flow medium from the discharge side of said blower to the intake side thereof, and a throttling element located in said starting duct, said throttling element being initially open and which is thereafter automatically closed in a self-regulating manner during the starting operation.

4. Apparatus as defined in claim 3 wherein said throttling element is provided with a spring-loaded closure member, the loading imposed by the spring being such that the spring travel is proportional to the pressure acting upon said closure member.

5. Apparatus as defined in claim 3 wherein said blower is located at the coil head chamber of the turbogenerator, the intake side of said blower being connected to the fluid coolant return duct of the cooling system and the discharge side thereof being connected with said coil head chamber, and said throttling element is constituted by a valve located in said chamber and including a spring-loaded piston actuated closure member controlling communication between said chamber and said return duct which establishes said starting duct, one side of said piston being in communication with and subjected to the pressure in said return duct, and the other side of said piston being in communication with and subjected to the pressure in said coil head chamber.

* * * * *